US005094438A

United States Patent [19]

Reist et al.

[11] Patent Number: 5,094,438

[45] Date of Patent: Mar. 10, 1992

[54] PROCESS FOR THE PRODUCTION OF MULTIPART PRINTED PRODUCTS, PRINTED PRODUCT PRODUCED BY THE PROCESS, AND DEVICE FOR CARRYING OUT THE PROCESS

[75] Inventors: Walter Reist, Hinwil; Werner Honegger, Tann Rüti, both of Switzerland

[73] Assignee: Ferag AG, Hinwil, Switzerland

[21] Appl. No.: 387,704

[22] Filed: Jul. 31, 1989

[30] Foreign Application Priority Data

Aug. 11, 1988 [CH] Switzerland ..... 03042/88

[51] Int. Cl.[5] ..... B65H 5/30

[52] U.S. Cl. ..... 270/55; 270/57; 270/54

[58] Field of Search ..... 270/37, 52, 53, 54, 270/55, 57, 58; 198/664

[56] References Cited

U.S. PATENT DOCUMENTS 3,059,391 10/1962 Volks ..... 270/55
3,663,007 5/1972 Preiter ..... 270/55
3,951,399 4/1976 Reist .
4,004,796 1/1977 Macke ..... 270/54
4,058,222 11/1977 Reist et al. .
4,402,496 9/1983 Muller ..... 270/55
4,489,930 12/1984 Meir ..... 270/55
4,533,132 8/1985 Wangermann ..... 270/55
4,605,213 8/1986 Hechler ..... 270/55
4,684,117 8/1987 Honegger ..... 270/55
4,706,951 11/1987 Leu .

*Primary Examiner*—Edward K. Look
*Assistant Examiner*—Therese M. Newholm
*Attorney, Agent, or Firm*—Willian Brinks Olds Hofer Gilson & Lione

[57] ABSTRACT

At a first feed station a first inner part is fed into an accommodation part which is driven so that it rotates in a conveyance direction. At a second feed station a second inner part is added side by side next to the first inner part. At a third feed station a folded outer part is placed, with its open side edge lying opposite the fold first, astride the thus collated inner parts. The end product thus formed has an outer part and two inner parts disposed therein, the folds of the inner parts running along the side edge of the outer part.

23 Claims, 4 Drawing Sheets

PROCESS FOR THE PRODUCTION OF MULTIPART PRINTED PRODUCTS, PRINTED PRODUCT PRODUCED BY THE PROCESS, AND DEVICE FOR CARRYING OUT THE PROCESS

BACKGROUND OF THE INVENTION

The present invention relates to a process for the production of multipart printed products, such as newspapers, periodicals and the like, a multipart printed product produced by the process, and a device for carrying out the process.

A device for the collection of folded printed sheets is known from EP-B1 0,095,603, or the corresponding U.S. Pat. No. 4,489,930. It has a multiplicity of saddle-type supports which are disposed like the rungs of a ladder on two parallel-rotating conveyor chains. Connected in series along the conveying upper side of the chains are several feed stations, at which folded printed sheets are placed astride the supports, the last printed sheet placed forming the outer part of the end product. At the end of the conveying section the end product, consisting of the collected printed sheets thus placed on top of each other, is lifted from the supports at a removal station and conveyed away.

EP-A2 0,218,872, or the corresponding U.S. Pat. No. 4,706,951 also discloses a device for the collation of printed products. It has a multiplicity of pocket-shaped accommodation parts which are disposed on a rotary driven conveyor chain transversely to the direction of rotation. Several feed stations at which printed products are inserted in the accommodation parts are provided along the conveying section. At the end of the conveying section the printed products thus collated to a multipart end product and disposed beside each other in the accommodation parts, are transferred to a further processing station through opening of the bottom of the accommodation parts. The printed products thus formed by collation have no folded outer part inside which the other printed products, the inner parts, are disposed.

A drum-type device for the insertion of printed products is known from Swiss Patent Specification 584,153, or the corresponding U.S. Pat. 3,951,399. In this device a first folded printed product is fed fold first at a first feed station into a pocket-shaped accommodation part of a star feeder. In the course of a rotation of the star feeder the printed product is opened and conveyed to the next feed station disposed staggered in the axial direction. At this feed station a further folded printed product is inserted into the first opened printed product. At further feed stations connected downstream further printed products are inserted into the first opened printed product, the inserted printed products in the end lying side by side each time, or already inserted printed products being opened and the next printed product being inserted into them. The multipart end products thus formed therfor have an outer part fed in first and at least one inner part disposed therein.

It is the object of the present invention to propose a process and produce a device with which types of multipart printed products other than those known hitherto can be produced and known printed products can be combined in another manner.

SUMMARY OF THE INVENTION

According to this invention, a process is provided for producing a multipart printed product comprising a folded outer part and at least one inner part, wherein the folded outer part has a fold and an open side edge lying opposite the fold. The process of this invention comprises the steps of combining each of the inner parts and the outer part in succession to form the multipart printed product, wherein at least one of the parts is combined by a process other than a collection process. This combining step comprises an end step of placing the outer part astride the at least one inner part with the open side edge first. As used herein the term "collection process" is intended to means a collection process of the type described above in conjunction with U.S. Pat. No. 4,489,930, in which folded sheets are placed astride supports.

This invention is also directed to a multipart printed product produced by the foregoing process, which product comprises the folded outer part and the at least one inner part disposed inside the outer part, wherein the inner part is folded on a second fold to define a second side edge lying opposite the second fold, and wherein the fold of the outer part runs alongside the second open side edge of the inner part.

This invention is also directed to a device for assembling a multipart printed product comprising a folded outer part and at least one inner part of the type described above. This device comprises at least one accommodation part having a bottom and a lateral supporting element, first feed station means for feeding the at least one inner part into the accommodation part, second feed station means, disposed downstream of the first feed station means, for placing the outer part astride the at least one inner part with the open side edge first to form an end product, and removal station means disposed downstream of the first and second feed station means for removing the end product.

In the process at least one inner part and one outer part are combined to an end product not exclusively by collection, the folded outer part in the end being placed astride the inner part with its open side edge lying opposite the fold first. Due to the fact that the outer part is not added until the end, inner parts can be combined in any desired manner. For example, it is possible for the inner parts to be collated or inserted into one another. But it is also possible for an inner part or several combined inner parts to have a further inner part placed astride it/them and possibly at least a further inner part added thereto from the side. Finally, the outer part is then placed astride all combined inner parts. The process thus permits the production of printed products in which the open side edge of an inner part lying opposite the fold always runs along the fold of the outer part.

Further preferred embodiments of the process and embodiment of the device for carrying out the process are indicated in the remaining claims.

The invention is now explained in greater detail with reference to the drawings:

DETAILED DESCRIPTION OF THE PRESENTLY PREFERRED EMBODIMENTS

Figure 1A:
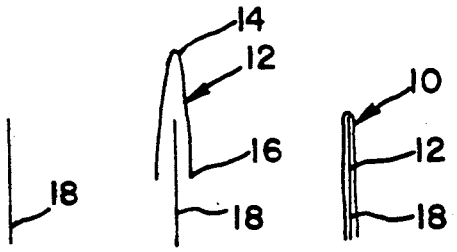
FIGS. 1 *a–g* show various embodiments of the process.

FIGS. 1*a-g* show individual process steps of seven different embodiments of a process for the production of multipart printed products, such as newspapers, periodicals and the like. The outer part of each end product 10 is indicated by 12. The inner part(s) astride which the outer part 12 is always placed, with its open side edge 16 lying opposite the fold 14 first, is (are) indicated by 18 to 24. The outer part 12 is always made up of a single folded printed sheet or several folded printed sheets fed in conjointly. An unfolded inner part 18 to 24 always has a single or several conjointly fed in printed sheets, and a folded inner part 18 to 24 can always consist of a single folded printed sheet or several folded printed sheets fed in conjointly.

As shown in FIG. 1*a*, the outer part 12 is placed astride the unfolded inner part 18 to form the end product 10.

Figure 1B:
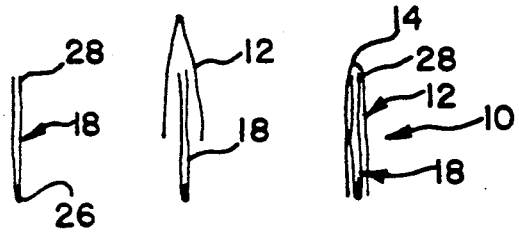

According to FIG. 1*b*, the outer part 12 is placed astride the folded inner part 18 with fold 26 at the bottom and open side edge 28 at the top. In the end product 10 the open side edge 28 of the inner part 18 consequently lies in the region of the fold 14 of the outer part 12.

Figure 1C:
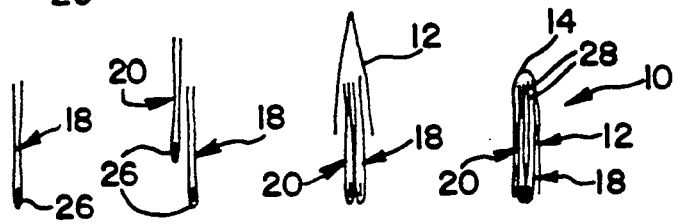

As shown in FIG. 1*c*, two folded inner parts 18, 20 are combined by collation with folds 26 at the bottom. The outer part 12 is placed astride these collated inner parts 18, 20, so that in the end product 10 the open side edges 28 of the inner parts 18, 20 lie in the region of the fold 14 of the outer part 12.

Figure 1D:
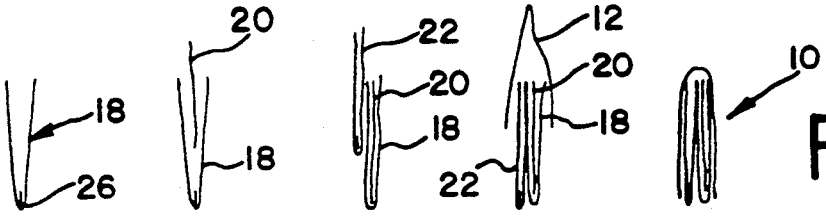

FIG. 1*d* shows how an opened first inner part 18 with fold 26 at the bottom has a further unfolded inner part 20 inserted into it. A further folded inner part 22 is then added laterally to these two inner parts 18, 20. Finally, the outer part 12 is placed astride all three combined inner parts 18, 20, 22.

Figure 1E:
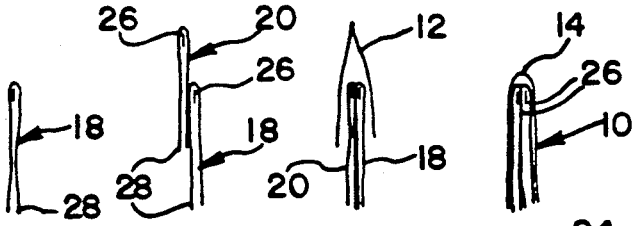

According to FIG. 1*e*, two folded inner parts 18, 20 with open side edge 28 at the bottom are first collated. The outer part 12 is placed astride these two collated inner parts 18, 20, so that in the end product 10 all folds 14, 26 are disposed together.

Figure 1F:
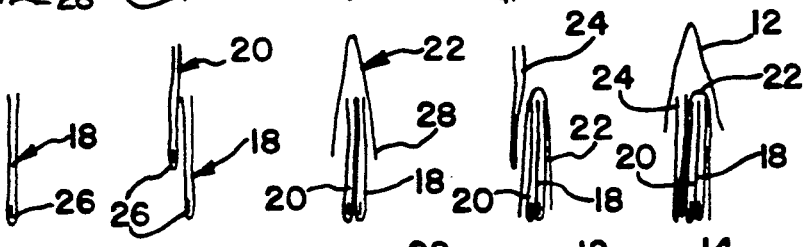

In the further development of the process according to FIG. 1*f*, two collated inner parts 18, 20 with fold 26 at the bottom have a further folded inner part 22 placed astride them with its open side edge 28 first. A further folded inner part 24 is subsequently added laterally beside the inner parts 18, 20, 22 thus combined. Finally, the outer part 12 is placed astride all inner parts 18, 20, 22, 24.

Figure 1G:
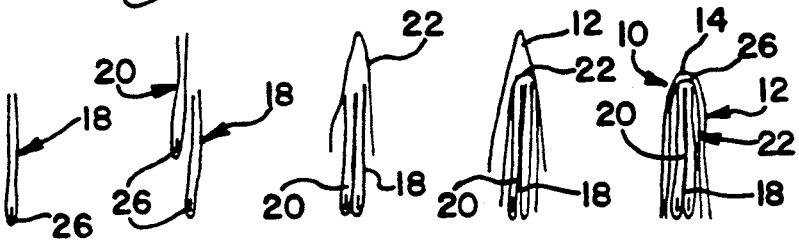

According to FIG. 1*g*, two folded inner parts 18, 20 are first collated with the fold 26 at the bottom. A further folded inner part 22 is subsequently placed astride these two collated inner parts 18, 20. The outer part 12 is then placed astride the inner parts 18, 20, 22, and the inner part 22 and the outer part 12 which have been placed astride the others are finally stapled together in the region of their folds 14, 26.

For the sake of completeness, it should also be mentioned that further embodiments of the process are conceivable, in which the outer part and the inner parts are not combined exclusively by collection to an end product, and in which the outer part is always placed astride the inner parts at the end.

Figure 2:
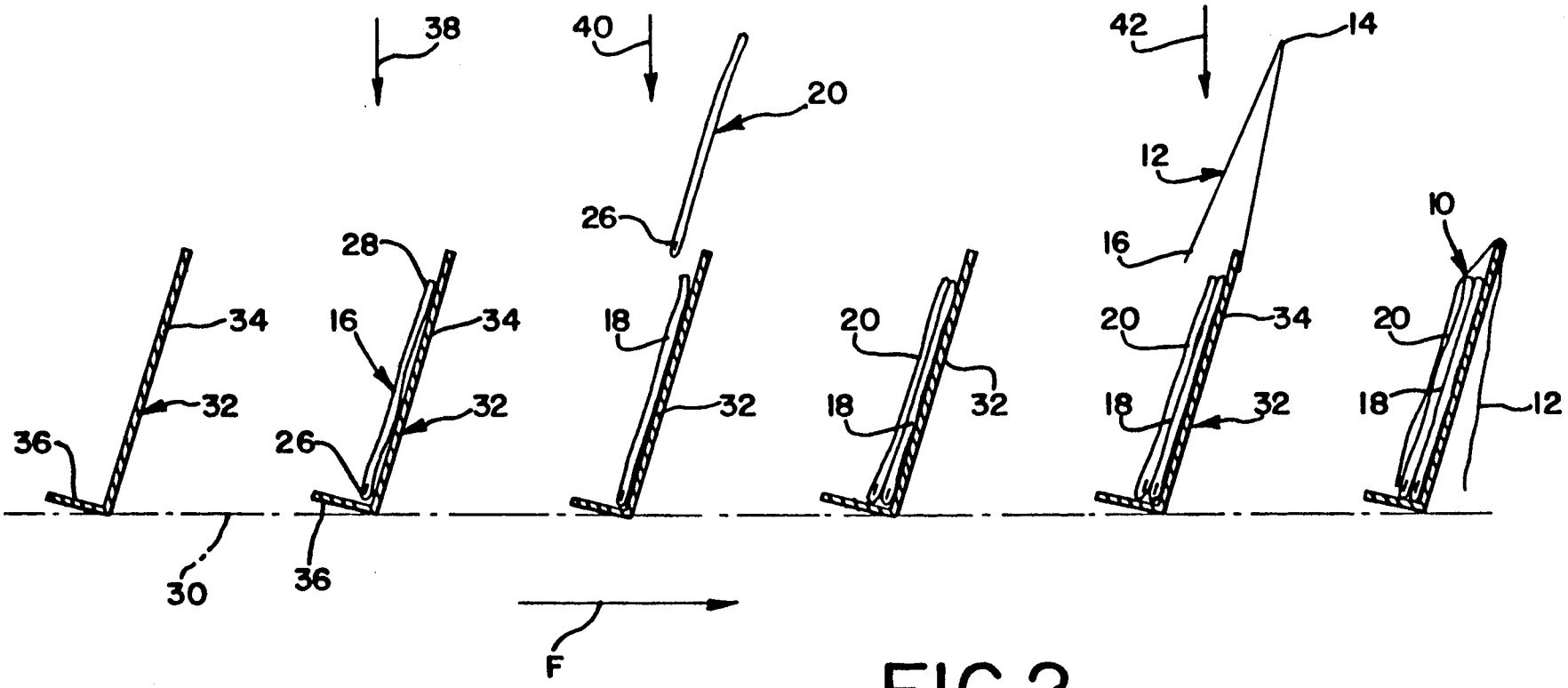
FIG. 2 shows a first embodiment of a device is simplified form.

FIG. 2 shows a first embodiment of a device for carrying out the process according to the invention, in greatly simplified form. This device has several accommodation parts 32 disposed spaced apart one after the other on a traction element 30, which is driven so that it rotates in conveyance direction F, and is shown by dashed and dotted lines. The lengthwise extension of the accommodation parts 32 runs at right angles to the conveyance direction F, and each accommodation part 32 comprises a flat sheet bent into an L-shape, the longer part of which runs upwards and is inclined forward slightly viewed in the conveyance direction F to form a supporting element 34. The shorter part of the flat sheet projects from the supporting element 34 opposite to the conveyance direction F and forms a bottom 36 of the accommodation part 32. Viewed in the conveyance direction F, three feed stations 38, 40, 42 indicated by arrows, are connected in series. At the first feed station 38 a first folded inner part 18 is fed into the accommodation part 32, fold 26 first. One side of the inner part 28 comes to rest against the supporting element 34, and the fold 26 comes to rest on the bottom 36. It should be noted that the supporting element 34 projects slightly beyond the open side edge 28 of the inner part 18. At the second feed station 40 a second inner part 20 is fed into the accommodation part 32, also fold 26 first, so that the two inner parts 18, 20 rest side by side against each other. Finally, at the feed station 42 the outer part 12 is placed, with its open side edge 16 lying opposite the fold 14 first, astride the two inner parts 18, 20 which have been collated, and the supporting element 34. The end product 10 thus formed is conveyed by means of the accommodation part 32 to a removal station (not shown) connected downstream of the feed stations 38, 40, 42 in conveyance direction F, where in a known manner the two inner parts 18, 20 are lifted and gripped together with the outer part 12, for example by a gripper, and conveyed away. For the sake of completeness, it should also be mentioned that the inner parts 28, 20 and the outer part 12 can be fed in by means of conveyors, or can be taken off stock stacks by means of known feeders and fed to the accommodation parts 32.

Figure 3:
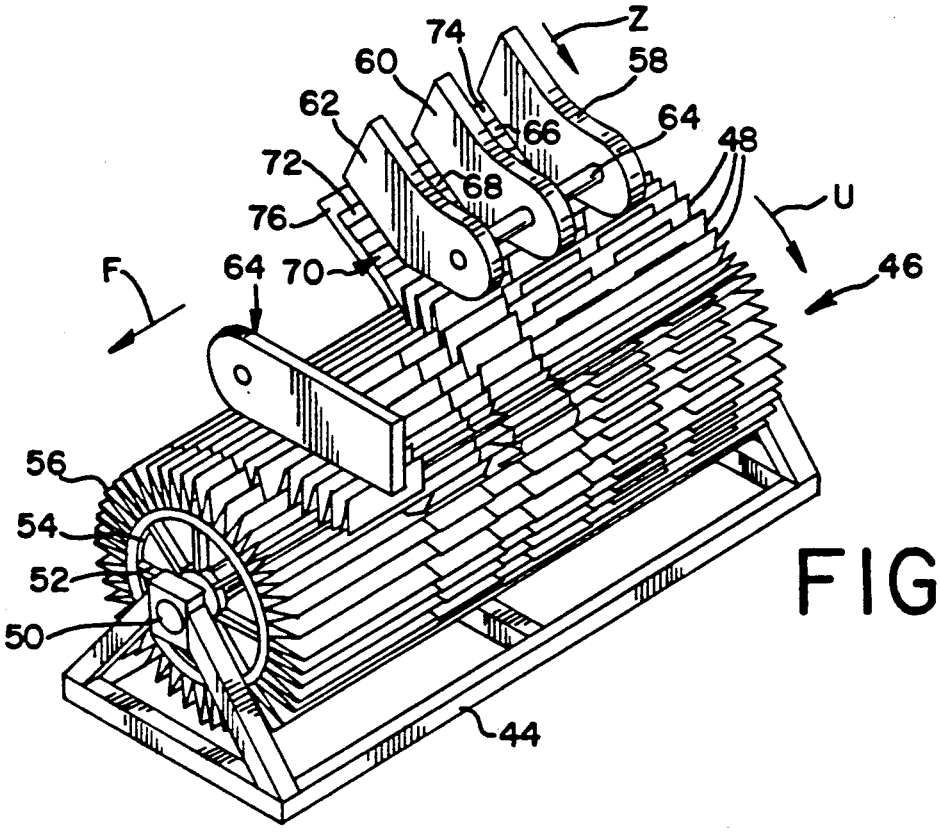
FIG. 3 shows in perspective view a drum-type embodiment of the device.

FIG. 3 shows a rotary drivable star feeder type of drum 46, rotatably mounted on a frame 44, with a multiplicty of pocket-shaped compartments 48 which extend in the lengthwise direction of the drum 46, and which rotate jointly about the axis of rotation 50 in the direction of the arrow U. Spoked wheels 52 (only one of which can be seen in FIG. 3), spaced apart in the axial direction, are mounted so that they rotate about the axis of rotation 50. Partitions 56, separating the compartment 48 from each other viewed in the direction of rotation U, are fixed on the rims 54 of the spoked wheels 52, said partitions projecting radially outwards and running the lengthwise direction of the drum 46.

Three feed conveyors 58, 60, 62, which are connected in series in arrow direction F, and which can be driven in synchronism by means of a common drive shaft 64, are provided above the drum 46. A removal conveyor 64, also shown only schematically, is connected downstream of these feed conveyors 58, 60, 62. Such feed conveyors 58, 50, 62 and removal conveyor 64 are generally known and can, for example, be constructed the same as or in a similar way to the conveyors disclosed in EPOS 0,218,872 or in Swiss Patent Specification 575,303, or the corresponding U.S. Patent No 4,706,951 or U.S. Pat. No. 4,058,202. The feed conveyors 58, 60, 62 convey folded printed sheets 66, 68, 70 in the feed direction Z to the drum 46, gripping these printed sheets 66, 68, 70 by their rear sides 72. Disposed upstream of the drum 46 is a baffle plate 74 which is disposed below the feed conveyors 58, 60 and runs essentially parallel to the feed direction Z, and which inserts the front edges of the printed sheets 66, 68 sliding thereon into the appropriate compartments 48. A schematically shown opening device 76 is provided below the feed conveyor 62, in order to open the printed sheets 70 fed in by the feed conveyor 62 at their front open side edger 78 and place them astride the appropriate partition 56 in such a way that each printed sheet half extends into a different compartment 48.

Figure 4:
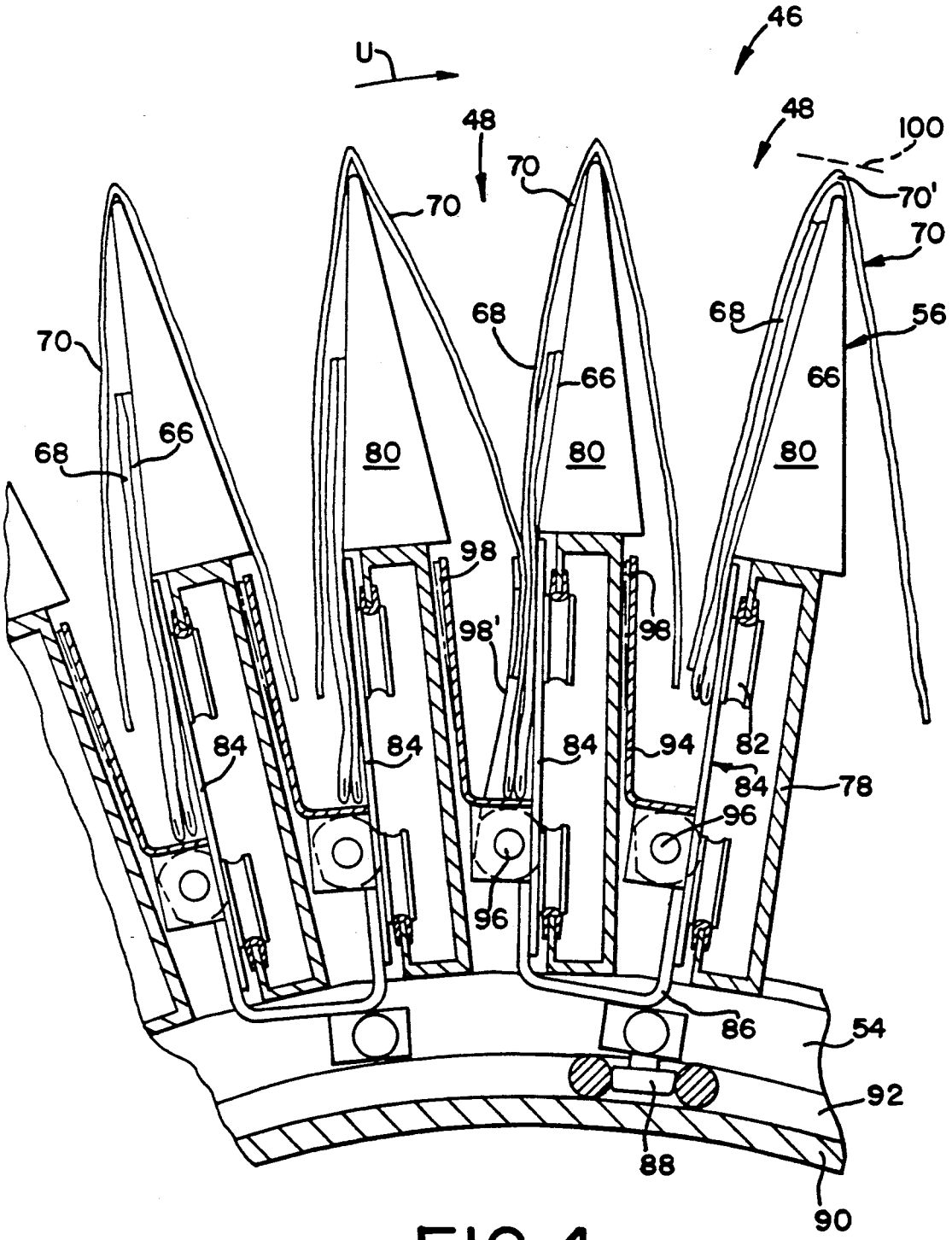
FIG. 4 shows an enlarged view of a vertical section through a part of the device shown in FIG. 3, and FIGS. 5-7 show three further embodiments of the device in a simplified form.

FIG. 4 shows a vertical section through a part of the drum 46 shown in FIG. 3, in the region of the last feed conveyor 62, viewed in the feed direction F, the successive processing steps on the printed sheets 66, 68, 70 being shown in concentrated form. Resting on the rim 54 of the spoked wheels 52 (see FIG. 3) are rails 78 which are C-shaped in cross-section, which run in the lengthwise direction of the drum 46, and which together with the supports 80 fixed thereon form partitions 56. Carriages 84 are mounted so that by means of guide rollers 82 they slide in the axial direction of the drums 46 in the rails 78. The carriages 84 are connected to each other in pairs by means of a bracket 86, on which a control roller 88 is rotatably mounted. The control rollers 88 are guided in a link 92 disposed on the circumferential surface of a fixed control cylinder 90. The development of the enclosed line 92 is S-shaped and during a rotation in arrow direction U the link 92 causes the carriages 84 to carry out a conveyance stroke in the arrow direction F and a back stroke in the opposite direction, the length of stroke essentially corresponding to the distance between two feed conveyors 58, 60; 60, 62 (see also FIG. 3). Each carriage 84 is provided on the side facing away from the guide rollers 82 with a curved guide element 94, projecting radially outwards, which forms the bottom of the appropriate compartment 48. Viewed in the radial direction, an axially extending swivel shaft 96 on which several spring-loaded clamping tongues 98 are fixed, only one of which is visible in each case, is mounted inside the guide element 94 on the carriage 84. The swivel shafts 96 and thus also the clamping tongues 98 can be swung from a rest position, in which they are covered by the appropriate guide element 94, into a clamping position, indicated by 98', and back again in accordance with a further link control which is not visible in this FIG. 4. Reference number 100 shows in dashed and dotted lines an endless rotating supporting belt which is provided under the drum 46 (FIG. 3). The fold 70' of the printed sheet 70 placed astride the support 80 comes to rest on its briefly, while the two other printed sheets 66, 68 fed into the compartments 48 are covered by the printed sheet 70.

The device according to FIGS. 3 and 4 works as follows:

When the drum 46 rotates in the rotation direction U the feed conveyor 58 feeds a first printed sheet 66 into each compartment 48. The clamping tongues 98 of the compartment in question are then taken into the clamping position 98' in order to hold the printed sheet 66 in the compartment 48 while the lower half of the conveyance route is being passed through. Following the conveyance stroke of the particular carriage 84, the printed sheet 66 is conveyed in conveyance direction F into the region of the next feed conveyor 60. Before the appropriate compartment 48 reaches the feed conveyor 60, the clamping tongues 98 in question are swung back into their rest position, following which the second printed sheet 68 fed in by the feed conveyor 60 can now be fed into the compartment 48. While the clamping tongues 98 are in their open position the carriages 84 in question make their return stroke, and then carry out a conveyance stroke again with their clamping tongues 98 holding the two printed sheets 66, 68 now lying against each other side by side. When the clamping tongues 98 are in their open position the carriages 84 in question make their return stroke, and then carry out a conveyance stroke again with their clamping tongues 98 holding the two printed sheets 66, 68 now lying against each other side by side. When the clamping tongues 98 are swung back again into the rest position, the feed conveyor 62 deposits a printed sheet 70 astride each support 80, so that the support 80 and the other printed sheets 66, 68 disposed in a compartment 48 are covered by it (cf. in particular FIG. 3, on the left). In the course of further rotation of the drum 46 the two printed sheets 66, 68 first fed in and the printed sheet halves of printed sheets 70 placed astride two adjacent supports 80 and extending into the compartment 48 in question are clamping by a clamping tongue 98 in each case (FIG. 4, center). Once a particular compartment 48 has now reached the region approximately in the center below the axis of rotation 50, the clamping tongues 98 in question are briefly opened, the two adjacent printed sheets 66, 68 falling in the radial direction outwards into the region of the supporting belt 100. The supporting belt 100 prevents the printed sheets 66, 68, 70 here from falling out of the compartments 48 or off the supports 80 (FIG. 4, on the right). The clamping tongues 98 are then taken back into their clamping position 98' and stay in this position until the combined printed sheets 66, 68, 70 have reached the removal conveyor 64. The printed sheets 66, 68, 70 are jointly gripped there and conveyed away. In the region between the feed conveyors 58, 60, 62 and the removal conveyor 64 further processing stations can be provided if desired. More than three printed sheets 66, 68, 70 can also be combined by extending the drum 46 and increasing the number of feed conveyors 58, 60, 62.

Figure 5:
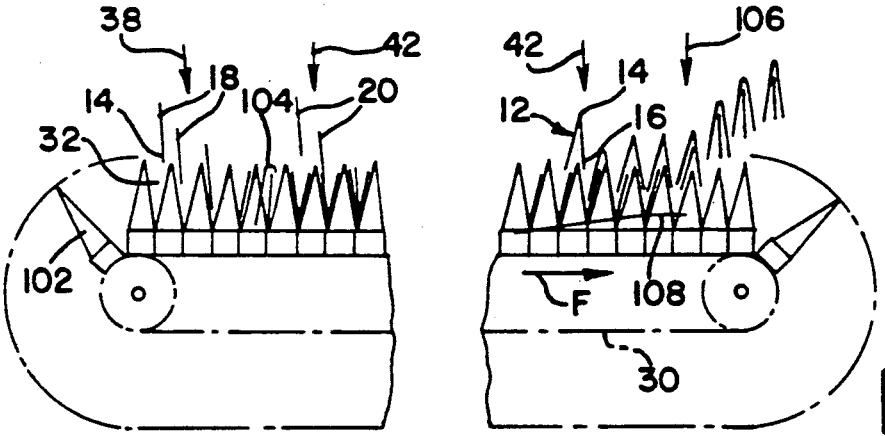

FIG. 5 shows a device which is very similar to the one described above and shown in FIG. 2. Saddle-type supports 102, which in the region of the conveying section alternately form a support 102 and an accommodation part 32, are fixed on a traction element 30 which is rotated in the conveyance direction F. Each support 102 has allocated to its an opening device 104 which is shown only schematically. Three feed stations 38, 40, 42, connected in series, for the infeed of inner parts 18, 20 or of the outer part 12 and a removal station 106 connected downstream of these are provided in the region of the conveying section. A guide element 108 is disposed in the region of the removal station 106 in order to lift the inner parts 18, 20 resting on the bottom of the accommodation parts 32.

At the first feed station 38 a folded inner part 18 is fed fold 14 first into each accommodation part 32. In the course of conveyance to the next feed station 40 this inner part 18 is opened by means of the opening device 104, following which the inner part 20 fed in at the feed station 40 is inserted into the opened first inner part 18. On the way to the third feed station 42 the inner part 18 is taken by the opening device 104 into the closed position again. At the feed station 42 a folded outer part 12 is placed, with its open side edge 16 lying opposite the fold 14 first, astride each support 102 and over the inner parts, 18, 20. On reaching the removal station 106 the two inner parts 18, 20 are lifted by means of the guide element 108 so far that the outer part 12 together with the inner parts 18, 20 can be gripped by a removal conveyor (not shown) and conveyed away.

Figure 6:
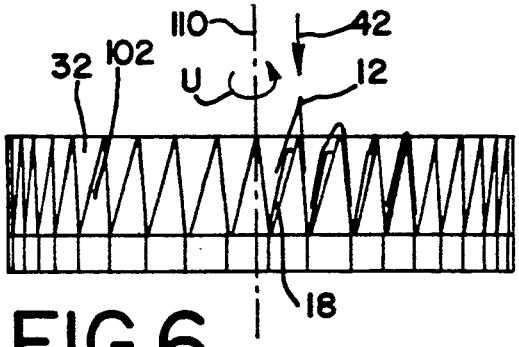

According to FIG. 6, the supports 102 are fixed on a carousel-type holding arrangement which is shown schematically by its vertical axis of rotation 110. The driven holding arrangement which rotates in the arrow direction U conveys the supports 102 or the accommodation part 32 bounded by them along the feed stations or removal station disposed on the periphery of the holding arrangement. Of these, however, only the feed station 42, which in a similar way to that of the device shown in FIG. 5 places the outer part 12 on the support 102 and the inner part 18, is shown.

Figure 7:
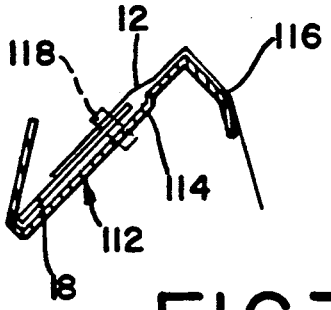

Finally, FIG. 7 shows in cross-section a fixed, elongated, V-shaped accommodation channel 112, one flank 114 of which is designed as a saddle-type support 116 at the top end. The accommodation channel 112 has allocated to it a conveyance element schematically shown by a carrier 118, for conveying the inner part 18 inserted into the accommodation channel 12 and the outer part 12 placed astride the support 116 and the inner part 18 along the accommodation channel 112 to a removal station (not shown).

It is not necessary for the supporting element 34 or the supports 80, 102, 116 to project beyond the inner parts 18, 20, 24, 66, 68; it is sufficient if they given the inner parts 18, 20, 24, 66, 68 enough lateral hold to prevent them from bending.

The process described above and the devices indicated are particularly suitable for processing newspapers, periodicals or the like. It is, however, also conceivable for only the outer part 12 to be a printed product, while the inner part 18, 20, 22, 24 can be another flat product such as, for example, a fabric sample.

For the sake of completeness, it should also be mentioned that the end product 10 can be processed further. For example, it can be combined with other products, bound, packed, addressed etc.

It is also possible to collect, collate or insert printed products with the device according to the invention.

Of course, it should be understood that a wide range of changes and modifications can be made to the preferred embodiments described above. It is therefore intended that the foregoing detailed description be regarded as illustrative rather than limiting and that it be understood that it is the following claims, including all equivalents, which are intended to define the scope of this invention.

We claim:

1. A process for producing a multipart printed product comprising a folded outer part and at least one inner part, said folded outer part having a folded edge and an open side edge lying opposite the fold, said inner parts comprising folded inner printed products or non-folded printed products, said folded inner part having a folded edge and an open side edge lying opposite the fold, said process comprising the following steps:

combining each of the inner parts and the outer part in succession to form the multipart printed product, wherein at least one of the parts is combined by a process other than a collection process, said step of combining comprising:

providing an accommodation part having a bottom and at least one lateral support element;

feeding said at least one inner part with an edge in front into said accommodation part such that one outer side of the inner part comes to rest against said support element and said edge rests against said bottom;

after said step of feeding said inner parts, as an end step, placing the outer part astride the at least one inner part with the open side edge first.

2. The process of claim 1 wherein the at least one inner part comprises at least first and second inner parts, and wherein the combining step comprises a component step of combining the first and second inner parts by a process selected from the group consisting of collation, insertion, and combinations thereof.

3. The process of claim 2 wherein the component step comprises a step of collating the first and second inner parts such that the first and second inner parts rest against each other side by side prior to the end step.

4. The process of claim 2 wherein the component step comprises a step of inserting the second inner part into the first inner part prior to the end step.

5. The process of claim 2 wherein the first inner part is folded and wherein the component step comprises a step of inserting the second inner part into the first inner part prior to the end step.

6. The process of claim 5 wherein the at least one inner part additionally comprises a third inner part, and wherein the component step additionally comprises a step of adding the third inner part laterally beside the first and second inner parts.

7. The process of claim 2 wherein the at least one inner part additionally comprises a third inner part, wherein the second inner part is folded and defines a second fold and a second open side edge opposite the second fold, and wherein the component step comprises the following steps:

placing the second inner part, with the second open side edge first, astride the first inner part; and then adding the third inner part laterally beside the second inner part prior to the end step.

8. The process of claim 1 wherein the at least one inner part comprises first and second inner parts, wherein the second inner part is folded and defines a second fold and a second open side edge opposite the second fold, and wherein the combining step comprises a component step of placing the folded second inner part, with the second open side edge first, astride the first inner part prior to the end step.

9. The process of claim 8 wherein the first inner part comprises a plurality of previously combined inner parts.

10. The process of claim 1 wherein the outer part comprises a plurality of folded printed sheets.

11. The process of claim 7 further comprising the step of stitching together the outer part and the folded inner part.

12. The process of claim 8 further comprising the step of stitching together the outer part and the folded second inner part.

13. The process of claim 1 wherein the at least one inner part comprises a plurality of inner parts, each defining a respective fold, and wherein the inner parts are arranged with the folds of all of the inner parts running alongside each other.

14. The process of claim 1 wherein said at least one inner part comprises a plurality of folded printed sheets.

15. The multipart printed product produced by the process of claim 1, comprising the folded outer part and the at least one inner part disposed inside the latter, wherein the inner part is folded at a second fold to define a second open side edge lying opposite the second fold, and wherein the fold of the outer part runs alongside the second open side edge of the inner part.

16. A device for assembling a multipart printed product comprising a folded outer part and at least one inner part, said folded outer part having a fold and an open side edge lying opposite the fold, said inner parts comprising folded inner printed products or non-folded printed products, said folded inner part having a folded edge and an open side edge lying opposite the fold, said device comprising:

at least one accommodation part having a bottom and a lateral supporting element; wherein at least one inner part is fed with an edge in front into said accommodation part; and wherein one outer side of the at least one inner part comes to rest against said supporting element and the edge comes to rest against said bottom;

first feed station means for feeding the at least one inner part into the accommodation part;

second feed station means, disposed downstream of the first feed station means, for placing the outer part astride the at least one inner part with the open side edge first to form an end product; and removal station means disposed downstream of the first and second feed station means, for removing the end product.

17. The device of claim 16 wherein each accommodation part has allocated to it a saddle-type supporting element for the outer part.

18. The device of claim 16 wherein the at least one accommodation part comprises a plurality of accommodation parts, and wherein the device further comprises a circulatingly driven traction element on which the accommodation parts are disposed in succession, said traction element guided along the first and second feed station means and the removal station means.

19. The device of claim 18 wherein the traction element is driven in a conveyance direction, and wherein each of the accommodation elements defines a lengthwise extension oriented substantially at right angles to the conveyance direction.

20. The device of claim 16 wherein the at least one accommodation part comprises a plurality of accommodation parts, wherein the device further comprises means for mounting the accommodation parts in succession about a common, at least substantially horizontal, axis of rotation such that the accommodation parts can be driven about the axis of rotation, and wherein each of the accommodation parts defines a lengthwise extension oriented substantially parallel to the axis of rotation.

21. The device of claim 20 wherein the device comprises:

a plurality of conveyance elements, each associated with a respective one of the accommodation parts, and acting in the direction of the respective lengthwise extension; and a plurality of holding elements, each associated with a respective one of the accommodation parts for temporarily holding at least the at least one inner part; and wherein the first and second feed station means and the removal station means are disposed staggered in succession along the axis of rotation.

22. The device of claim 16 wherein the at least one accommodation part comprises a plurality of accommodation parts, and wherein the device further comprises a carousel-type holding arrangement on which the accommodation parts are mounted, said holding arrangement being rotatable about a substantially vertical axis.

23. The device of claim 16 wherein the at least one accommodation part comprises a single, channel shaped accommodation part, wherein the device further comprises a conveyance element for conveying the inner and outer parts along the accommodation part, and wherein the first and second feed station means and the removal station means are disposed in series along the accommodation part.

* * * * *

UNITED STATES PATENT AND TRADEMARK OFFICE

CERTIFICATE OF CORRECTION

PATENT NO. : 5,094,438

DATED : March 10, 1992

INVENTOR(S) : Walter Reist et al.

It is certified that error appears in the above-identified patent and that said Letters Patent is hereby corrected as shown below:

In column 4, line 17, after "42" insert --,--.

In column 4, line 21, delete "28" and substitute therefor --18--.

In column 4, line 40, delete "28" and substitute therefor --18--.

In column 4, line 63, delete "50" and substitute therefor --60--.

In column 5, line 55, delete "its" and substitute therefor --it--.

In column 6, lines 11 through 16, delete "When the clamping tongues 98 are in their open position the carriages 84 in question make their return stroke, and then carry out a conveyance stroke again with their clamping tongues 98 holding the two printed sheets 66, 68 now lying against each other side by side."

In column 6, line 26, delete "clamping" and substitute therefor --clamped--. (first occurrence)

In column 6, line 52, delete "its" and substitute therefor --it--.

UNITED STATES PATENT AND TRADEMARK OFFICE

CERTIFICATE OF CORRECTION

PATENT NO. : 5,094,438

DATED : March 10, 1992

INVENTOR(S) : Walter Reist et al.

It is certified that error appears in the above-identified patent and that said Letters Patent is hereby corrected as shown below:

In column 7, line 4, after "parts" delete ",".

In column 7, line 7, before "inner" insert --two--.

In column 7, line 26, delete "12" and substitute therefor --112--.

Signed and Sealed this

Sixth Day of June, 1995

*Attest:*

*Attesting Officer*

BRUCE LEHMAN

*Commissioner of Patents and Trademarks*